US006371590B1

(12) United States Patent
Hah

(10) Patent No.: US 6,371,590 B1
(45) Date of Patent: Apr. 16, 2002

(54) METHOD FOR TESTING NOZZLES OF AN INKJET PRINTER

(75) Inventor: Chong-Ho Hah, Kyonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/419,772

(22) Filed: Oct. 18, 1999

Related U.S. Application Data

(63) Continuation-in-part of application No. 08/827,698, filed on Apr. 9, 1997.

(30) Foreign Application Priority Data

Apr. 9, 1996 (KR) ..... 96/10615

(51) Int. Cl.[7] ..... B41J 2/01
(52) U.S. Cl. ..... 347/19
(58) Field of Search ..... 347/7, 19, 23

(56) References Cited

U.S. PATENT DOCUMENTS

| | | | | |
|---|---|---|---|---|
| 4,493,993 A | | 1/1985 | Kanamuller et al. | 250/222.1 |
| 4,590,482 A | | 5/1986 | Hay et al. | 347/19 |
| 4,768,045 A | | 8/1988 | Koto | 347/19 |
| 4,835,435 A | | 5/1989 | Yeung et al. | 310/324 |
| 4,872,028 A | | 10/1989 | Lloyd | 347/14 |
| 4,907,013 A | * | 3/1990 | Hubbard et al. | 347/19 |
| 4,996,487 A | * | 2/1991 | McSparran et al. | 324/549 |
| 5,164,747 A | | 11/1992 | Osada et al. | 347/19 |
| 5,182,580 A | * | 1/1993 | Ikeda et al. | 347/19 |
| 5,319,389 A | | 6/1994 | Ikeda et al. | 347/19 |
| 5,369,420 A | | 11/1994 | Bartky | 347/19 |
| 5,457,389 A | | 10/1995 | Shibata | 324/514 |
| 5,508,722 A | * | 4/1996 | Saito et al. | 347/17 |
| 5,596,353 A | | 1/1997 | Takada et al. | 347/19 |
| 5,610,639 A | | 3/1997 | Takada et al. | 347/19 |

* cited by examiner

*Primary Examiner*—Craig A. Hallacher

(57) ABSTRACT

The present invention relates to a nozzle testing method of an inkjet printer, and specifically, to a nozzle testing method which tests for a defects in each nozzle of a print head by operating every nozzle of a print head in order, and displaying 1) an error message that at least one nozzle is malfunctioning, 2) the quantity of malfunctioning nozzles in a print head, 3) the quantity of functioning nozzles in a print head, and 4) which nozzles are malfunctioning, if any. The present invention includes an inkjet printer that sends a nozzle operating signal to each nozzle for operating each nozzles in order. When each nozzle is in operation, a corresponding logic level of voltage from a head installation sensing circuit is produced to be examined for a defect in a nozzle. The result is indicated on a display. As a result, instead of finding a defect manually, a user can be alarmed when there is a defect automatically to take appropriate steps to correct the problem. The invention uses bits stored in a buffer to indicate whether each nozzle passed or failed the test. As a result, the position of a bit indicating a malfunctioning nozzle identifies which nozzle malfunctions. In addition, by reviewing the buffer, it can be determined by counting the number of bits indicating a malfunctioning nozzle the number of malfunctioning nozzles in a print head.

22 Claims, 6 Drawing Sheets

METHOD FOR TESTING NOZZLES OF AN INKJET PRINTER

CROSS-REFERENCE TO RELATED APPLICATIONS

This application is a continuation-in-part of Applicant's Ser. No. 08/827,698, filed in the U.S. Patent & Trademark Office on Apr. 9, 1997.

CLAIM OF PRIORITY

This application makes reference to, incorporates the same herein, and claims all benefits accruing under 35 U.S.C. §119 and §120 arising from an application for Method For Testing nozzles of an Inset Printer earlier filed in the Korean Industrial Property Office on Apr. 9, 1996 and there duly assigned Ser. No. 10615/1996.

1. Field of the Invention

The present invention relates to a method for automatically testing whether or not nozzles of an inkjet printer are functioning properly, and reporting 1) whether there are any malfunctioning nozzles for a given print head, 2) the number of malfunctioning nozzles in a print head, 3) the number of functioning nozzles in a print head, and 4) which particular nozzles are malfunctioning, if any.

2. Description of the Prior Art

U.S. Pat. No. 4,996,487 for an Apparatus for Detecting Failure of Thermal Heaters in Ink Jet Printers to McSparran et al discloses a method and apparatus for testing heating elements of a thermal jet printing device. U.S. Pat. No. 4,907,013 for Circuitry For Detecting Malfunction of Ink Jet Printhead to Hubbard et al discloses a device and method for detecting nozzle malfunction in an inkjet printer. The results of a 32 nozzle printhead are stored in a 32 bit word. A value of "0" indicates that the nozzle is functioning properly and a value of "1" indicates that there is a malfunction with the nozzle. If the central processor is able to compensate for the malfunctioning nozzle(s), the printhead is stepped in the vertical direction and an additional pass is made over the print medium to fill in for the missing dots from the first pass. This condition is called a soft error and the printhead continues printing without notifying the user of the presence of a malfunctioning nozzle. If the central processor is unable to compensate for the malfunctioning nozzle, the printhead is disabled. This is referred to as a fatal error. U.S. Pat. No. 5,182,580 for Ink Jet Recording Apparatus With Abnormal State Detection to Ikeda et al discloses an apparatus for detecting an abnormality in the ink liquid passage. What is needed is a system that automatically tests whether each nozzle of a printhead is functioning properly, and reporting to the user 1) whether there are any malfunctioning nozzles for a given print head, 2) the number of malfunctioning nozzles in a print head, 3) the number of functioning nozzles in a print head, and 4) which particular nozzles are malfunctioning, if any. This information can be reported to the user via CRT display, Liquid Crystal Display (LCD), Light Emitting Diode (LED), printer, or storage into memory of a computer.

SUMMARY OF THE INVENTION

It is therefore an object to provide a system which tests the operability of each nozzle of a printhead, store the results in a bitmap in software, and notify the user whenever there is a malfunctioning nozzle.

It is also an object to provide a system which tests the operability of each nozzle of a printhead, store the results, store the results in a bitmap in software, and notify the user whenever there is a malfunctioning nozzle, even if the number of nozzles is more than 32.

It is still an object to provide a system which automatically tests each nozzle of a print head to determine whether each nozzle is malfunctioning, and to display, print, and record the number of malfunctioning nozzles.

It is still yet an object to provide a system which automatically tests each nozzle of a print head to determine whether each nozzle is malfunctioning, and to display, print, and record the number of functioning nozzles.

It is still another object to provide a system which automatically tests each nozzle of a print head to determine whether each nozzle is malfunctioning, and to identify which particular nozzles are malfunctioning, and to display, print, and record the position and location of the malfunctioning nozzles.

This and other objects can be achieved by providing a circuit with a D flip flop that converts the operational state of a nozzle of a printhead into a bit to be stored in a word. A bit with a logic level of "1" indicates that a corresponding nozzle is working properly and a bit with a logic level of "0" indicates that a corresponding nozzle is malfunctioning. If any of the nozzles are malfunctioning, the user is made aware of the situation through an LED or an LCD panel.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
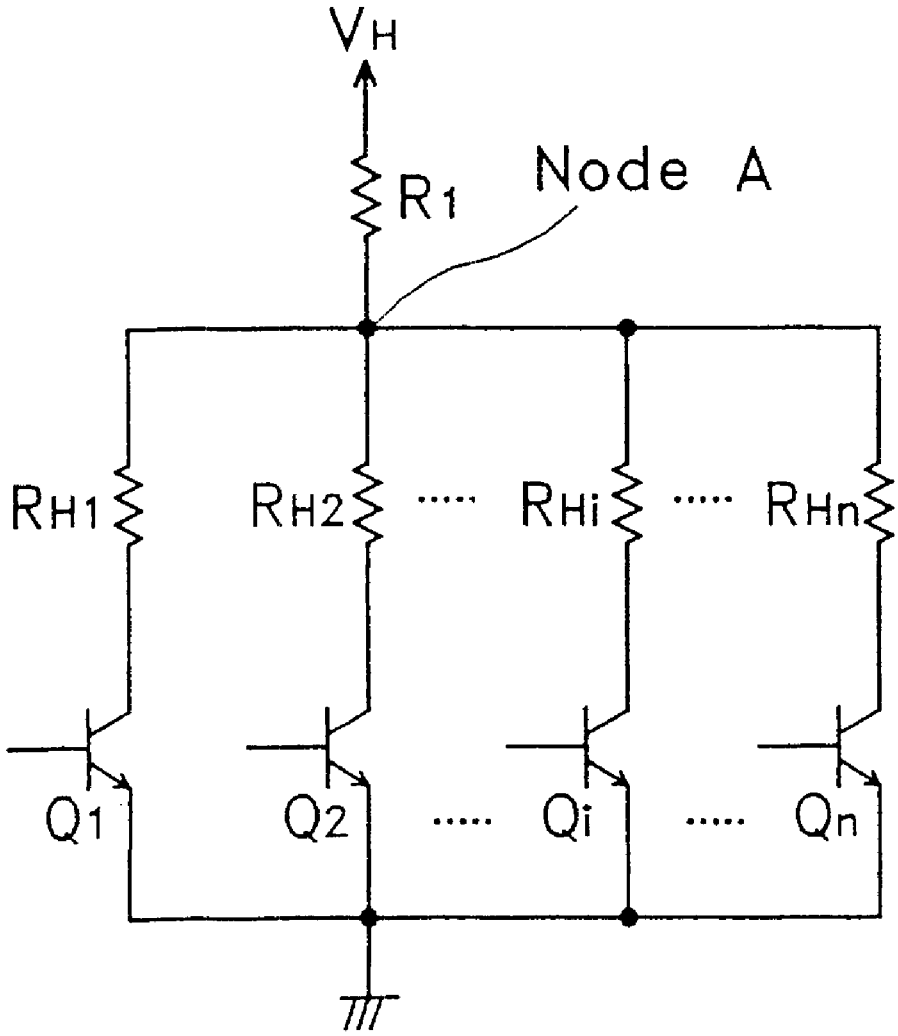
FIG. 1 shows a circuit for operating a print head nozzle of an earlier inkjet printer.

An inkjet printer generally includes a print head which is usually located in an ink carriage in which ink is stored. The print head usually has a number of nozzles for spreading ink on a paper to print data. FIG. 1 illustrates a nozzle operating circuitry for operating an 'n' number of nozzles of a print head. Each nozzle of a print head is equipped with an exothermic resistor capable of heating ink. As shown in the drawing, each of exothermic resistor $R_{H1}$ through $R_{Hn}$ is linearly connected to each of respective nozzle operating transistors $Q_1$ through $Q_n$. The exothermic resistors $R_{H1}$ through $R_{Hn}$ are connected to a nozzle operating power supply ($V_H$) having a power supply voltage of 24V by means of a resistor $R_l$.

Figure 2:
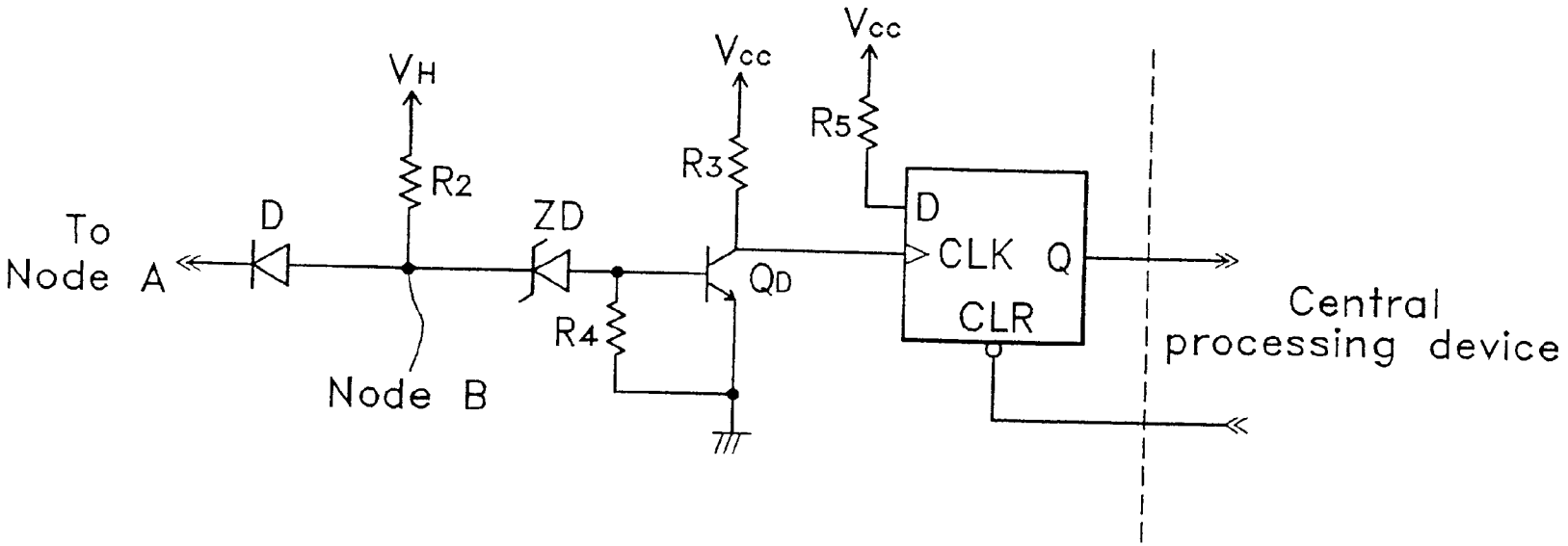
FIG. 2 shows a circuit for sensing a proper installation of a print head of an earlier inkjet printer.

The following is a more specific description based on FIGS. 1 & 2. Each nozzle operating transistor is turned on in accordance with a nozzle operating signal generated by a central processing device (not shown) of a base terminal. As a result, the exothermic resistor corresponding to the turned on transistor is provides current to generate heat. For example, among an 'n' number of nozzle operating transistors $Q_l$ through $Q_n$, when the $i^{th}$ transistor is turned on in accordance with a nozzle operating signal, the exothermic resistor $R_H$, which is connected to the $i^{th}$ transistor, is then provided with a current generated by a nozzle operating power supply $V_H$ through the resistor $R_l$ for generating heat.

Due to the heat generated according to the above step, ink is heated, and in turn, bubbles are produced. As the bubbles expand, ink spurts out of the nozzle to produce a dot on a paper. Such steps are repeated while an ink cartridge having a print head moves back and forth to produce a number of dots on a paper to produce a word or a graphic.

FIG. 2 illustrates an additional circuit, called a head installation sensing device, for sensing proper installation of an ink cartridge (print head) whenever the cartridge is changed due to an ink outage. Such head installation sensing circuit senses a change in electrical potential of a node A of the nozzle operating circuit shown FIG. 1. The potential at node A is then changed to a signal voltage carrying a logic level for generating a sensing signal to the central processing device. Consequently, the central processing device determines the situation of the print head by means of the logic level of the signal voltage yielded from the head installation sensing circuit.

The following is a more specific description of FIG. 1 and FIG. 2. The head installation sensing circuit includes a zenor diode (ZD) with the cathode terminal being connected to the nozzle operating voltage ($V_H$) through the resistor $R_2$; an NPN type of transistor $Q_D$ which has a base terminal being connected to an anode terminal of said zenor diode (ZE); and a data flip-flop which has a clock input terminal (CLK) being connected to a collector terminal of transistor $Q_D$ and also is a data input terminal being connected to a logic circuit voltage ($V_{CC}$) having a power supply voltage of about 5V through the resistor $R_5$.

An output terminal Q of data flip-flop and a clearing terminal (CLR) are connected to the central processing device such that the output terminal generates a sensing signal to the central processing device. Afterwards, the clearing terminal receives a clearing signal generated from the central processing device.

The transistor $Q_D$ may be switched by means of a voltage drop across resistor $R_4$ which connects the base terminal and the emitter terminal. Moreover, since the collector terminal is connected to the logic circuit power supply ($V_{CC}$) by the resistor $R_3$, depending upon the switching mode of the transistor $Q_D$, the electric potential of the collector terminal determined. Moreover, cathode terminals of the zenor diode ZD is connected to an anode of a diode D and the cathode of diode D is connected to node A of the nozzle operating circuit.

In the head installation sensing circuit as described above, a voltage of the nozzle operating power supply $V_H$ is provided to the resistor $R_2$, the zenor diode ZD, and the resistor $R_4$. However, depending on characteristics of the zenor diode ZD, the head installation sensing device is electrically conductive by means of a zenor voltage provided in opposite direction of the both sides. As a result, the transistor $Q_D$ is turned on based on a change in electric potential, which is generated due to an increase in voltage of the resistor $R_4$ located in between the base terminal and the emitter terminal. As a result, the electrical potential of the collector terminal decreases.

During aforementioned process, when the central processing device generates a nozzle operating signal to turn on a certain nozzle operating transistor accordingly, the voltage of the nozzle operating power supply $V_H$ is provided when the resistor $R_l$ and the exothermic resistor of the nozzle forces to distribute the voltage. Moreover, the electric potential of the node A decreases with respect to the electric potential at node B, and the difference in electric potential causes the diode D to be electrically conductive. As a result, a difference in the electrical potential between node A and node B decreases, and the zenor diode ZD is shut off when the zenor voltage is to provided in opposite direction of both sides.

Furthermore, when the difference in electrical potential between the base terminal and the emitter terminal becomes zero, the transistor $Q_D$ is turned off. As a result, the electrical potential of the power supply of the collector terminal of the transistor $Q_D$ increases to as much as the voltage from the logic circuit power supply ($V_{CC}$).

When the nozzle operating signal generated from the central processing device is shut off, the nozzle operating transistor is also turned off. As a result, the electrical potential of node A becomes greater than that of node B. Consequently, the diode D is shut off, and the electrical potential of node B increases at the same time. The zenor diode ZD is electrically conductive as the difference in the electrical potential of the both sides becomes greater than the zenor voltage. Finally, when the electrical potential between the base terminal and the emitter terminal becomes greater due to an increase in voltage of the resistor $R_4$, the transistor $Q_D$ is turned on, and the electric potential of the collector terminal decreases.

As the nozzles began to operated according to the steps as mentioned above, in the collector terminal of the transistor $Q_D$, the electric potential changes from high to low or from low to high in turn to generate a pulse voltage.

The clock pulse generated from the collector terminal is then added to a clock input terminal CLK. As a result, the data flip-flop uses clocking so that a logic level of the signal voltage, which was provided to the data input terminal D, may be outputted through the output terminal Q. At the same time, the data input terminal receives a voltage of the high logic level (HIGH; "1") from the power supply $V_{CC}$ of the logic circuit. Therefore, depending on a clock pulse inputted to the clock input terminal CLK, a signal voltage of the high logic level (HIGH; "1") is output to the output terminal Q.

The central processing device receives the signal voltage as a sensing signal for sensing proper installation of a print head. Afterwards, the central processing device sends a clear signal to a clear terminal CLR of the data flip-flop to be reset In other words, the central processing device periodically sends a nozzle operating signal to determine the operating condition of nozzles as well as the proper installation of print head by means of signal voltage sent from the output terminal Q of the data flip-flop.

However, such head installation sensing circuit for an inkjet printer only periodically checks for proper installation of the print head. Therefore, when a break-down of a nozzle occurs in the circuit to cause a malfunction of the print head, which is electrically very sensitive, the defect cannot be sensed. Moreover, in order to test for any defect in the nozzles, every nozzle must be operated on to print a test pattern, such that a user must examine the pattern for finding any sign of defects manually.

Considering the drawbacks of an earlier sensing circuit, the object of the present invention is to provide a system which sequentially operates each nozzle in a print head to discover the presence of malfunctioning nozzles. Afterwards, results are indicated on either a display device or a print medium alerting the user 1) an error message when at least one nozzle is malfunctioning, 2) the quantity of malfunctioning nozzles in a print head, 3) the quantity of functioning nozzles in a print head, and 4) which individual nozzles are malfunctioning, if any. Therefore, a user may not have to look for any defects manually for making a subsequent adjustment.

Figure 3:
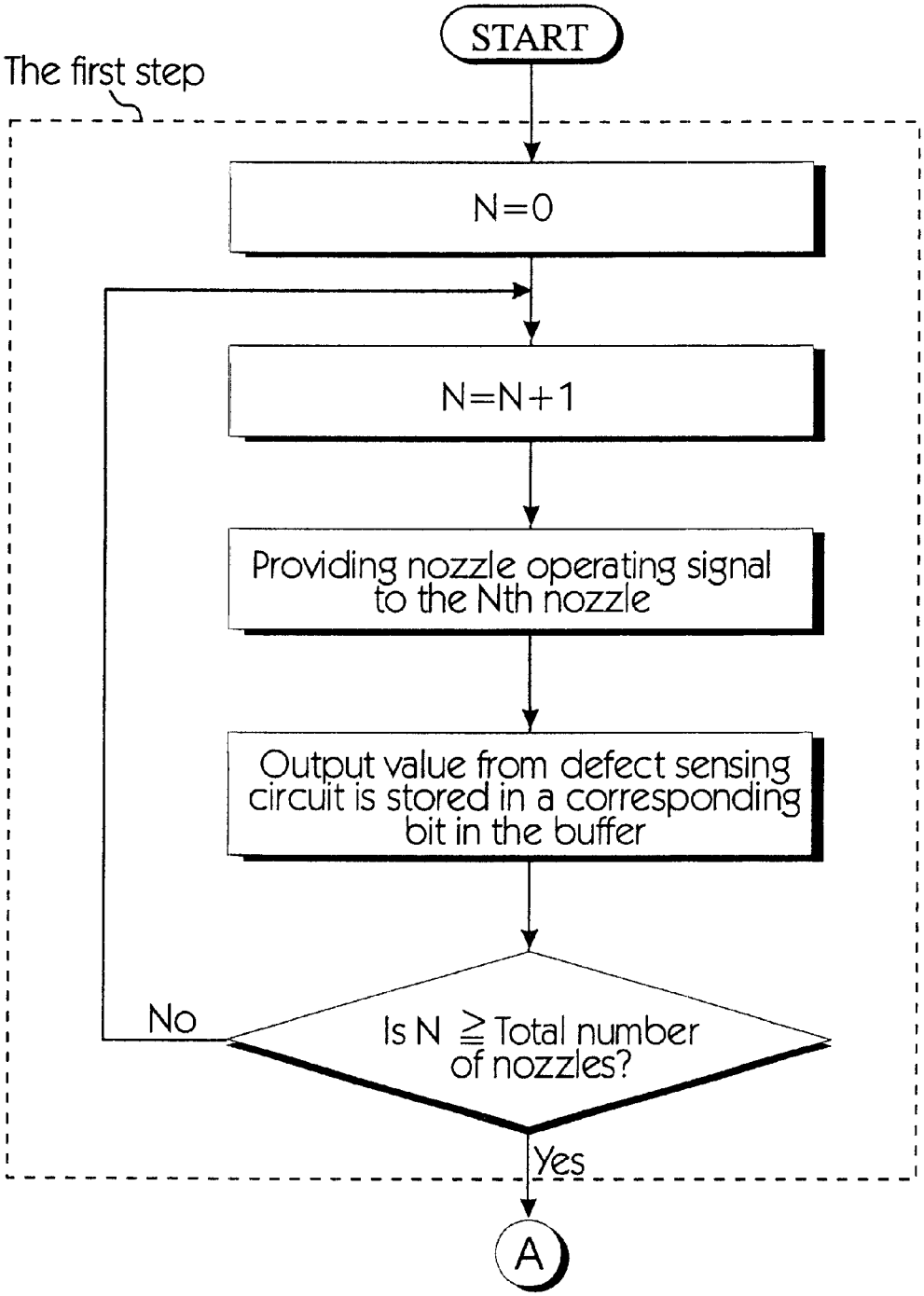
FIGS. 3 and 3*a* together form a flow chart of a method showing each step in order for testing nozzles according to the present invention.
Figure 3A:
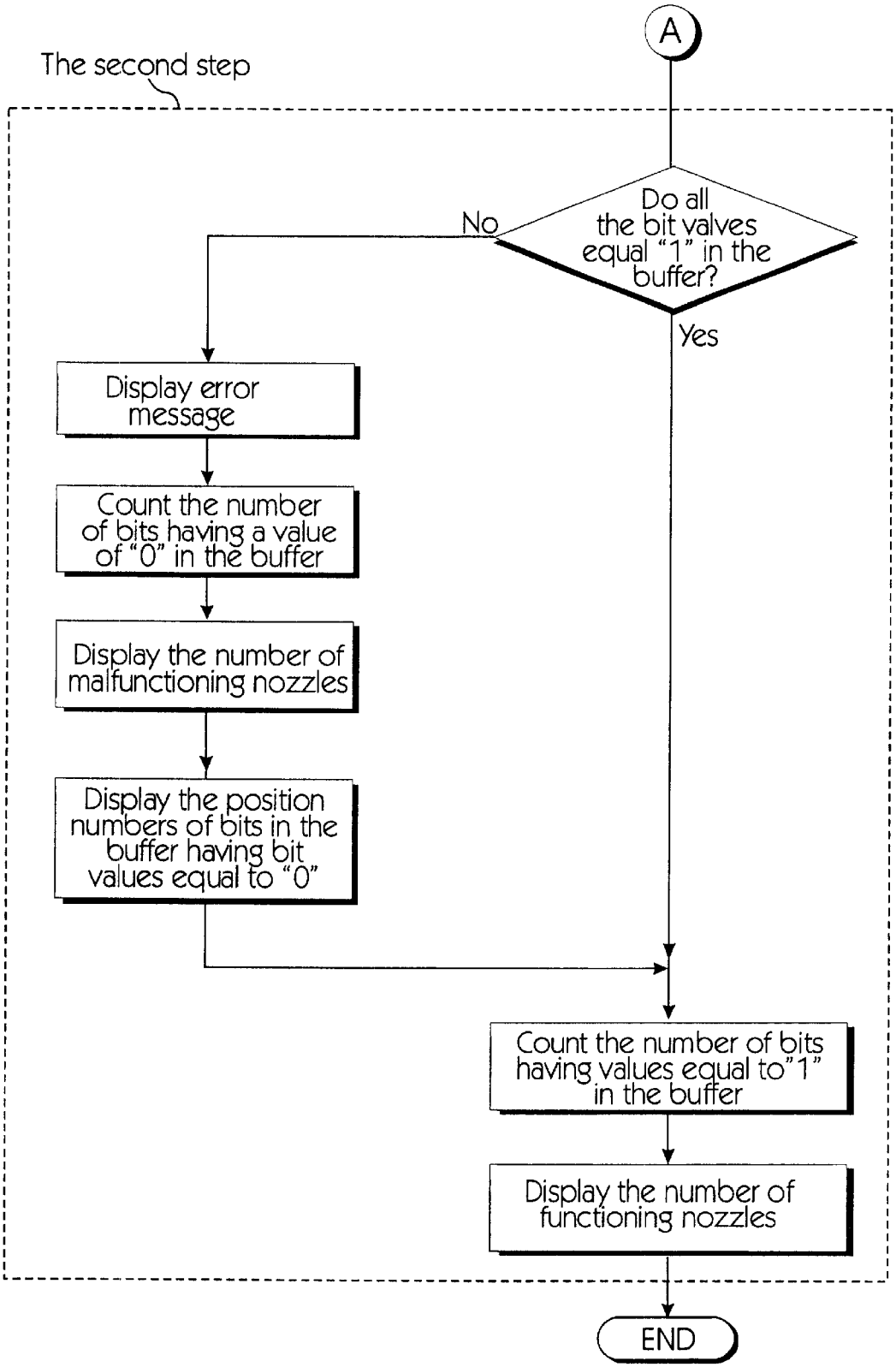

The following describes a method for testing nozzles of an inkjet printer according to the present invention by referring to the drawings. FIG. 3 illustrates a flow chart of a method showing each step for sequentially testing nozzles of an inkjet printer according to the present invention. In the first step, every nozzle of a print head starts to operate sequentially upon receiving an operating signal. Consequently, a corresponding logic level value of a signal voltage sent from a head installation sensing circuit is stored in a buffer indicating whether or not a particular nozzle is malfunctioning. The second step is to test for a malfunctioning in each and every nozzle by using the value of the data bits stored in the buffer from the first step.

More specifically, in said first step shown in FIG. 3, there are a number of sub-steps. The first sub-step is to set the system in a beginning mode by designating a variable N for counting nozzles. In the next two sub-steps, said variable N is incremented to eventually equal the number of nozzles, providing a nozzle operating signal to the Nth nozzle. In the next sub-step, a logic level value of the signal voltage, which is sent from the data flip-flop of the sensing circuit, is read for storing in a respective bit location located in a buffer. The final sub-step is for resetting the data flip-flop after storing the logic level value for a particular nozzle.

In the second step shown in FIG. 3, there are again a number of sub-steps. The first sub-step determines whether or not all of the bit values in the buffer are equal to "1". Remember that a bit value equal to 1 indicates a functioning nozzle and a bit value equal to "0" indicate the malfunctioning nozzle. If there is at least one bit in the buffer whose bit value is not equal to "1", but it is equal to "0", an error message is displayed informing the user that there are at least one malfunctioning nozzles in the printhead. In addition, the number of bits containing a value of "0" is counted and the quantity of malfunctioning nozzles in the printhead is displayed or recorded. In addition, it is also displayed or recorded which contains the value "0". This indicates which nozzle numbers are malfunctioning and provides the user with identification of the malfunctioning nozzles.

Should all of the bit values in the buffer equal "1", the foregoing steps are bypassed as each nozzle in the printhead is properly functioning. Whether or not all of the bit values in the buffer are set equal to "1", a count of the number of bits having values equal to "1" in the buffer is made and this number is displayed, indicating the number of functioning nozzles in the printhead. This completes the step of testing and displaying and recording the operability of a plurality of nozzles in a given printhead.

During the receiving stage of said operating signal as mentioned above, a test pattern, which is registered in a corresponding area in the RAM, is read to be outputted to the nozzle operating circuit ultimately for yielding a nozzle operating signal to nozzles.

Figure 4A:
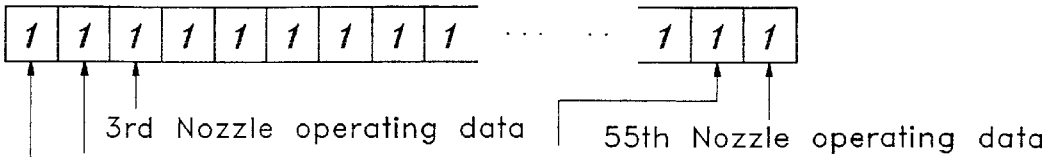
FIG. 4*a* shows a test pattern registered in a respective area of RAM for operating 56 nozzles, and each of 56 bit is set to "1"

Specifically, an inkjet printer having 56 nozzles, which also includes a RAM having 56 bits, registers "1" to the bit corresponding to the nozzle that needs to be operated. Such pattern is then output to the nozzle operating circuit to operate the nozzles. Otherwise, when all nozzles need to be operated at once, all bits in the RAM are registered with "1" to be sent to the nozzle operating circuit as shown in FIG. 4*a*.

Figure 4B:
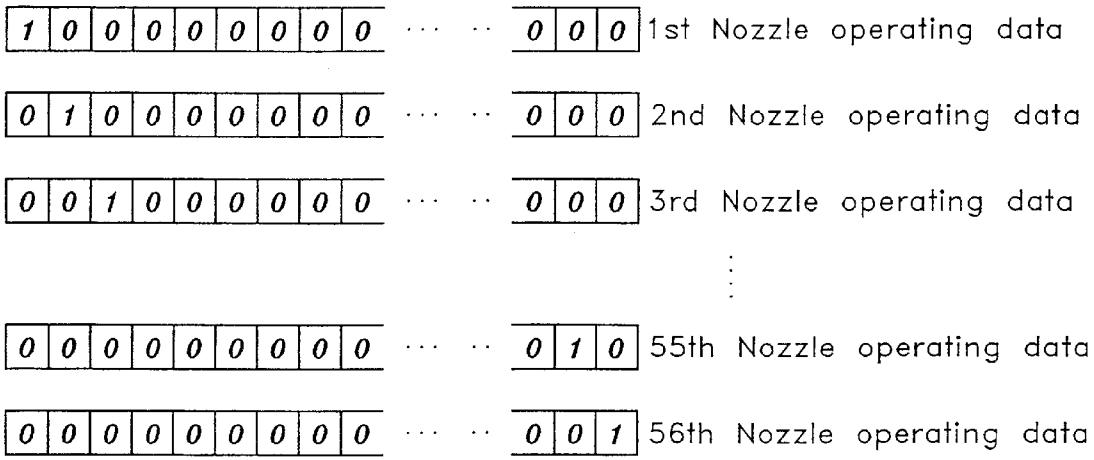
FIG. 4*b* shows test patterns registered in a respective area of RAM for sequentially operating 56 nozzles, and only the bit corresponding to the nozzle which needs to be operated is set to "1"

On the other hand, when the nozzles need to be operated sequentially, the variable N is counted in ascending order to register "1" to the only bit among 56 bits which the counted value designates. As a result, a distributed test pattern (shown in FIG. 4*b*) is to be read and outputted to as the nozzle operating circuit.

In the second step, all the data bit values stored in the buffer are examined, and the result is displayed through a displaying device. At this point, all values should be "1". If the result indicates that not all values are 1, then the system concludes that there is a defect in at least one of the nozzles. As a result, it is communicated to the user that: 1) an error message indicating that at least one nozzle is malfunctioning, 2) the quantity of malfunctioning nozzles in a print head, 3) the quantity of functioning nozzles in a print head, and 4) an identification of which ones of the nozzles are malfunctioning, if any. This information is communicated to a user via a LED display, LCD display, printer, or storage in memory or on a CRT display.

For the buffer mentioned above to operate all the nozzles and store all the logic level values, the buffer must have a number of bits that exactly corresponds to a total number of nozzles. For example, a printer, which has 56 nozzles, should have a buffer having 56 bits.

The following describes the method of testing nozzles according to the present invention in more specific detail. When an inkjet printer receives a current, then the head installation sensing circuit illustrated in FIG. 1 and FIG. 2 also receives a current. The zenor diode ZD is electrically conductive by receiving a voltage flowing in opposite direction. As a result, the transistor $Q_D$ is turned on such that electric potential of the collector terminal shows a low level voltage. Moreover, the Data flip-flop also shows a voltage signal of a low logic level.

In such condition, the central processing device proceeds the first step of method for testing nozzles by assigning a test pattern having a corresponding number of bits to a total number of nozzles to the RAM. Moreover, a variable N having a value of "0" is created for setting the system in the beginning stage. Furthermore, in order to temporarily store a result outputted from the head installation sensing circuit in the buffer, the buffer must also have a corresponding number of bits to a total number of nozzles.

Afterwards, said variable N is counted by increment of one. Then, said variable N registers a test pattern for operating the first nozzle by setting "1" on the first bit designated by the count value. Finally, the test pattern is read and outputted to the nozzle operating circuit.

As a result, among the nozzle transistors $Q_l$ through $Q_n$, the first nozzle transistor $Q_l$ is turned on, and the voltage of nozzle operating power supply $V_H$ is provided to the exothermic resistor $R_{Hl}$ for generating heat. At this point, the print head is located in a parking area inside of an inkjet printer for preventing the ink from drying. The ink, which spurts out when the nozzles start to operate, is managed in this area.

When the first nozzle transistor is turned on, electric potential of the node A decreases with respect to that of the node B to cause the diode D to be electrically conductive. Consequently, the zenor diode ZD and the transistor $Q_D$ are shut off. As a result, the level of electric potential of the collector terminal of the transistor $Q_D$ change from low to high.

In the central processing device, when the nozzle operating signal, which is provided to the nozzle operating circuit, is shut off, the nozzle operating transistor $Q_l$ turns off as well. Therefore, the electric potential of the node A becomes greater than that of the node B to cause the diode D to be shut off, and in turn, the zenor diode ZD is electrically conductive again. Consequently, the transistor $Q_D$ is turned off again to cause the electric potential level of the collector terminal of the transistor $Q_D$ changes from high to low.

As the first nozzle is in operation, the electric potential of the collector terminal of the transistor $Q_D$ changes to generate a voltage pulse. This clock pulse is inputted to the clock input terminal (CLK) of the Data flip-flop. As a result, the data flip-flop which is connected to input is terminal D by means of the nozzle operating circuit ($V_{CC}$), outputs a voltage of high logic level (HIGH ; "1") to the output terminal Q. The central processing device receives this output for registering "1" in the first bit of the buffer and for generating a clear signal to the clear terminal (CLR) to reset the data flip-flop. Moreover, the central processing device compares the count value of the variable N to the total number of nozzles. If the count value is not greater or same as the total number of nozzles, then the variable N continues to be incremented of one. Subsequently, in order to make the count value in accordance with the variable N, "1" is registered in the second bit of the RAM area for adding a test pattern for operating the second nozzle only. The test pattern is then read and outputted to the nozzle operating circuit for operating the second nozzle.

When the above process of registering "1" to the corresponding bit continues to repeat based on the count value of the variable N in ascending order, a test pattern develops for operating the nozzles. The test pattern is then sent to the nozzle operating circuit to operate every nozzle sequentially. Finally, the logic level of the voltage outputted from the head installation sensing device is received for registering in the corresponding bit in the buffer.

Figure 5:
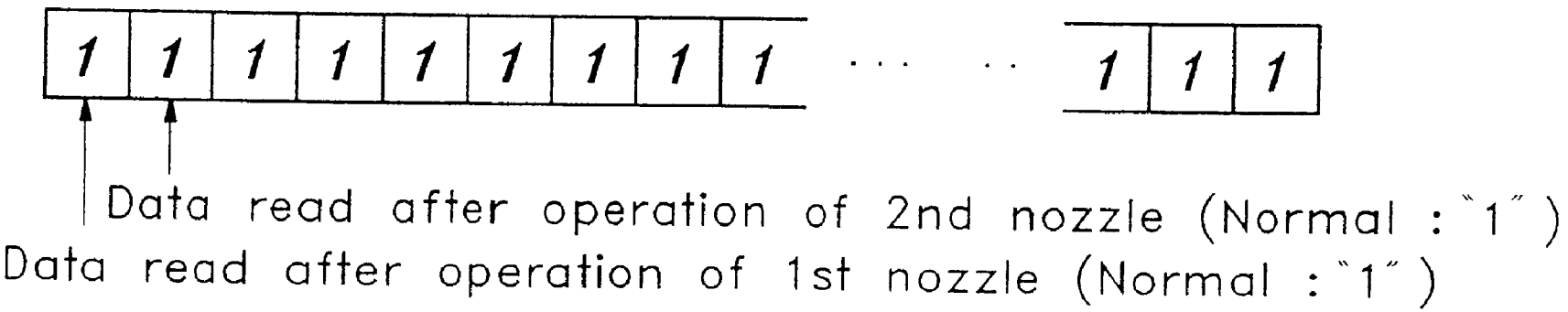
FIG. 5 shows a 56-bit buffer for storing a logic level of voltage sent from a D flip-flop of a head installation sensing circuit to a respective bit while nozzles are operating.

When every nozzle is operated and every count value is registered in the buffer the first step is completed. In the second step, every bit value of the data in the buffer is examined to determine the condition of the nozzles. As illustrated in FIG. 5, if the printer having 56 nozzles is in sound condition, every bit in the buffer should be registered with a "1".

However, if there is a defect on $i^{th}$ nozzle, there would not be a change in electrical potential of the node A when the nozzle operating signal is sent to the nozzle operating transistor $Q_i$. Consequently, a clock pulse would not reach the clock input terminal (CLK) of the data flip-flop. As a result, when there is no change in the data flip-flop, a low signal voltage of the low logic level (LOW; "0") is sent to the central processing device to be registered in the corresponding bit of the buffer as a "0".

Subsequently, during the second step, when the central processing device examines every bit value in the buffer, a defect in one or more nozzles may be detected. In such case, an error message is sent to a displaying device indicating that at least one nozzle in the print head has a defect. Ideally, the error message should be displayed using a liquid crystal display panel, but other means, such as a light emitting diode, can be used as well. In the case there are more than one malfunctioning nozzle, the number of malfunctioning nozzles is also displayed or printed out or recorded. In any case where there is a malfunction of at least one nozzle, the malfunctioning nozzles are identified. The location of the malfunctioning nozzles can be determined from the bit location of "0"'s in the buffer. For instance, if a "0" bit is located in the first position of the buffer, then it is concluded that the first nozzle of the printhead is malfunctioning. If the 38th bit location in the buffer is a "0", then it is determined that the 38th nozzle in the printhead is malfunctioning, and so on.

As mentioned above, the testing of nozzles for finding a defect starts every time a power supply is provided. However, ideally, the testing for nozzles should not be limited to time when the power supply is provided. Rather, the testing should also be conducted every time an ink cartridge (print head) is changed.

In a brief summary, the present invention provides a method to test every nozzle for finding defects and indicating the results of that test. The results include 1) an error message indicating that at least one nozzle is malfunctioning, 2) the quantity of malfunctioning nozzles in a print head, 3) the quantity of functioning nozzles in a print head, and 4) identification of specifically which of the nozzles are malfunctioning, if any. Each of these results are automatically determined and the user is notified of these results by either display, printing, and/or storage into memory of a computer.

What is claimed is:

1. A testing method of an inkjet printer for finding a defect in print head nozzles, wherein said inkjet printer comprises a head installation sensing circuit for providing a corresponding nozzle operating signal to at least one nozzle constituting the printer head, detecting via a voltage change whether or not the relevant nozzle is electrically operated, outputting a logic level of "0" if there is a defect in the nozzle, and outputting a logic level of "1" if there is not a defect in the nozzle, whereby indicating whether or not said printer head is installed, said testing method comprising:

a first step of sequentially providing a nozzle operating signal to each of said nozzles of said printer head and operating said nozzles one by one;

a second step of storing said logic level value output from said head installation sensing circuit into a buffer corresponding to said nozzle operating signal;

a third step of determining whether or not the corresponding nozzle is defective when said level is output as "0", by checking a data bit value stored in said buffer in said second step;

a fourth step of displaying an error message on a display device when the result of said third step indicates that at least one nozzle is defective;

a fifth step of displaying the number of defective nozzles present in said printer head; and a sixth step of identifying and displaying which ones of said print head nozzles are malfunctioning when the result of said third step indicates that at least one nozzle is defective.

2. The testing method according to claim 1, said buffer assigning an equal number of bits in a random access memory to each of the nozzles.

3. The testing method according to claim 1 wherein said sixth step comprises a liquid crystal display panel for displaying said identification information.

4. The testing method according to claim 1 wherein said sixth step comprises a cathode ray tube display for displaying said identification information.

5. The testing method according to claim 1, wherein testing for finding a defect in an inkjet printer begins every time power supply is provided.

6. The testing method according to claim 1, wherein testing for finding a defect in an inkjet printer begins every time a printed head is changed.

7. A method for testing for malfunctioning nozzles in a print head of an inkjet printer, comprising the steps of:

providing a print head having a first plurality of nozzles;

providing a sensing circuit that determines whether a particular one of said first plurality of nozzles of said print head is malfunctioning;

providing a buffer in random access memory containing a first plurality of bits, each bit corresponding to each one of said first plurality of nozzles;

providing a display device;

providing nozzle operating signals to each one of said first plurality of nozzles;

sensing, via said sensing circuit, whether each one of said first plurality of nozzles is functioning or malfunctioning;

recording, in said buffer in said random access memory, whether each one of said first plurality of nozzles is functioning or malfunctioning; and displaying, on said display terminal, the number of said first plurality of nozzles that are malfunctioning.

8. The method of claim 7, further comprising the step of identifying and displaying which ones of said first plurality of nozzles are malfunctioning.

9. The method of claim 8, further comprising the step of displaying the number of said first plurality of nozzles of said print head are properly functioning.

10. The method of claim 7, wherein said display device is a cathode ray terminal.

11. The method of claim 7, wherein said display device is a liquid crystal display.

12. The method of claim 7, wherein said display device is a light emitting diode.

13. A method of testing for malfunctioning nozzles on a print head, said print head comprising a first plurality of nozzles, said method of testing comprising revealing to a user results of said testing of an operating condition of each one of said first plurality of nozzles, said method comprising the steps of:

providing said printhead having said first plurality of nozzles, each of said first plurality of nozzles being uniquely identified by a nozzle number and a location on said printhead;

providing a sensing circuit that determines whether a particular one of said first plurality of nozzles of said print head is malfunctioning;

providing a buffer in random access memory containing a first plurality of bits, each bit corresponding to respective ones of said first plurality of nozzles;

providing a user interface to reveal results of said test to said user;

providing nozzle operating signals sequentially to each one of said first plurality of nozzles;

sensing, sequentially, via said sensing circuit, whether each one of said first plurality of nozzles is functioning or malfunctioning;

recording, using binary data, in said buffer in said random access memory whether corresponding ones of said first plurality of nozzles are functioning or malfunctioning; and revealing, to said user, said results of said testing, said results comprising the number of malfunctioning nozzles in said print head, the number of functioning nozzles in said printhead and identifying which ones of said first plurality of nozzles of said printhead are malfunctioning.

14. The method of claim 13, wherein identifying which nozzles of said printhead are malfunctioning comprises revealing a nozzle number and a location of each malfunctioning nozzle in said print head determined by said testing.

15. The method of claim 14, wherein said revealing step comprises printing said results of said testing out on a sheet of recording medium.

16. The method of claim 14, wherein said revealing step comprises displaying on a liquid crystal display said results of said testing.

17. The method of claim 14, wherein said revealing step comprises having said results of said testing being displayed on a cathode ray tube display.

18. The method of claim 14, wherein said revealing step comprises having said results of said testing being stored in a memory.

19. The method of claim 13, wherein said revealing step comprises printing said results of said testing out on a sheet of recording medium.

20. The method of claim 13, wherein said revealing step comprises displaying on a liquid crystal display said results of said testing.

21. The method of claim 13, wherein said revealing step comprises having said results of said testing being displayed on a cathode ray tube display.

22. The method of claim 13, wherein said revealing step comprises having said results of said testing being stored in a memory.

* * * * *